US005456221A

United States Patent [19]

Schechter

[11] Patent Number: 5,456,221

[45] Date of Patent: Oct. 10, 1995

[54] ROTARY HYDRAULIC VALVE CONTROL OF AN ELECTROHYDRAULIC CAMLESS VALVETRAIN

[75] Inventor: Michael M. Schechter, Framington Hills, Mich.

[73] Assignee: Ford Motor Company, Dearborn, Mich.

[21] Appl. No.: 369,433

[22] Filed: Jan. 6, 1995

[51] Int. Cl.[6] ..... F01L 9/02

[52] U.S. Cl. ..... 123/90.12; 123/90.11

[58] Field of Search ..... 123/90.11, 90.12, 123/90.13, 90.15

[56] References Cited

U.S. PATENT DOCUMENTS

| | | | |
|---|---|---|---|
| 3,209,737 | 10/1965 | Omotehara et al. | 123/90.12 |
| 3,455,209 | 2/1967 | Preston et al. . | |
| 3,738,337 | 6/1973 | Massie . | |
| 4,446,825 | 5/1984 | Giardini et al. . | |
| 4,821,689 | 4/1989 | Tittizer et al. | 123/90.12 |
| 4,930,464 | 6/1990 | Letsche | 123/90.12 |
| 5,058,857 | 10/1991 | Hudson . | |
| 5,193,494 | 3/1993 | Sono et al. . | |
| 5,209,453 | 5/1993 | Aota et al. . | |
| 5,255,641 | 10/1993 | Schechter . | |
| 5,275,136 | 1/1994 | Schechter et al. . | |
| 5,335,633 | 8/1994 | Thien | 123/90.12 |
| 5,339,777 | 8/1994 | Cannon | 123/90.12 |
| 5,363,816 | 11/1994 | Yorita et al. | 123/90.12 |
| 5,367,990 | 11/1994 | Schechter | 123/90.12 |
| 5,375,419 | 12/1994 | Wright et al. | 129/90.12 |

*Primary Examiner*—Henry C. Yuen
*Assistant Examiner*—Weilun Lo
*Attorney, Agent, or Firm*—Donald A. Wilkinson; Roger L. May

[57] ABSTRACT

An engine valve assembly (10) within an electrohydraulic camless valvetrain cooperates with a hydraulic system (8) having a low pressure branch (70) and a high pressure branch (68) to selectively open and close engine valve (12). Engine valve (12) is affixed to a valve piston (16) within a piston chamber (18). A volume (42) below piston (16) is connected to high pressure branch (68) and a volume (20) above piston (16) is selectively connected to the high pressure branch (68) or the low pressure branch (70) via a rotary valve (34), to effect engine valve opening and closing. A motor (60) effects the rotation of the rotary valve (34).

10 Claims, 4 Drawing Sheets

VALVE LIFT
100
104
110
112
118
TIME

WINDOW OPENING AREA
102
108
114
TIME

LIFT L
106
TIME

LIFT L
116
TIME

ROTARY HYDRAULIC VALVE CONTROL OF AN ELECTROHYDRAULIC CAMLESS VALVETRAIN

FIELD OF THE INVENTION

The present invention relates to a system to control intake and exhaust valves in an electrohydraulic camless valvetrain of an internal combustion engine.

This application is related to application Ser. Nos. 08/167,302 filed Dec. 16, 1993, now U.S. Pat. No. 5,375,419; 08/168,343 filed Dec. 17, 1993, now U.S. Pat. No. 573.817, 08/227,825; filed Apr. 7, 1994, now U.S. Pat. No. 5,419,301 08/266,066; filed Jun. 27, 1994, now U.S. Pat. No. 5,410, 0994, 08/286,312; filed Aug. 5, 1994 now U.S. Pat. No. 5,404,844; and to co-pending applications titled ELECTRIC ACTUATOR FOR SPOOL VALVE CONTROL OF ELECTROHYDRAULIC VALVETRAIN which is Ser. No. 08/369,460, ELECTRIC ACTUATOR FOR ROTARY VALVE CONTROL OF ELECTROHYDRAULIC VALVETRAIN which is Ser. No. 08/369,640, and SPOOL VALVE CONTROL OF AN ELECTROHYDRAULIC CAMLESS VALVETRAIN which is Ser. No. 08/369,459 filed herewith.

BACKGROUND OF THE INVENTION

The increased use and reliance on microprocessor control systems for automotive vehicles and increased confidence in hydraulic as opposed to mechanical systems is making substantial progress in engine systems design possible. One such electrohydraulic system is a control for engine intake and exhaust valves. The enhancement of engine performance to be attained by being able to vary the timing, duration, lift and other parameters of the intake and exhaust valves' motion in an engine is known in the art. This allows one to account for various engine operating conditions through independent control of the engine valves in order to optimize engine performance. All this permits considerably greater flexibility in engine valve control than is possible with conventional cam-driven valvetrains.

One such system is disclosed in U.S. Pat. No. 5,255,641 to Schechter (assigned to the assignee of this invention). A system disclosed therein employs a pair of solenoid valves per engine valve, one connected to a high pressure source of fluid and one connected to a low pressure source of fluid. They are used to control engine valve opening and closing. While this arrangement works adequately, the number of solenoid valves required per engine can be large. This is particularly true for multi-valve type engines that may have four or five valves per cylinder and six or eight cylinders. A desire arises, then, to reduce the number of valves needed in order to reduce the cost and complexity of the system. If each pair of solenoid valves is replaced by a single actuator, then the number of valves is cut in half.

This same patent also disclose using rotary distributors to reduce the number of solenoid valves required per engine, but then employs an additional component rotating in relationship to the crankshaft to properly time the rotary distributors. This tie-in to the crankshaft may reduce some of the benefit of a camless valvetrain and, thus, may not be ideal. Further, the system still employs a separate solenoid valve for high pressure and low pressure sources of hydraulic fluid. A desire, then, exists to further reduce the number of valves controlling the high and low pressure sources of fluid from the hydraulic system.

SUMMARY OF THE INVENTION

In its embodiments, the present invention contemplates a hydraulically operated valve control system for an internal combustion engine. The system includes a high pressure hydraulic branch and a low pressure hydraulic branch, having a high pressure source of fluid and a low pressure source of fluid, respectively. A cylinder head member is adapted to be affixed to the engine and includes an enclosed bore and chamber. An engine is valve shiftable between a first and a second position within the cylinder head bore and chamber, and a hydraulic actuator has a valve piston coupled to the engine valve and reciprocable within the enclosed chamber which thereby forms a first and a second cavity which vary in displacement as the engine valve moves. A rotary valve assembly is mounted to the cylinder head member and includes a sleeve and a cylindrical valve body mounted within the sleeve. The valve body includes at least one high pressure groove and at least one low pressure groove and the sleeve includes three channels and at least one window operatively engaging the third sleeve channel. The cylinder head member includes three ports, a first port connecting the first sleeve channel to the high pressure branch, a second port connecting the second sleeve channel to the low pressure branch and a third port connecting the third sleeve channel to the first cavity. The three ports and sleeve channels are oriented such that the valve body can be rotated so that the high pressure groove aligns with the first sleeve channel and the window, neither of the grooves aligns with the window, and the low pressure groove aligns with the second sleeve channel and the window, sequentially. The cylinder head member further includes a high pressure line extending between the second cavity and the high pressure branch. The valve control system also includes actuator means for rotating the rotary valve relative to the sleeve.

Accordingly, an object of the present invention is to provide an electrohydraulic camless valvetrain as disclosed in U.S. Pat. No. 5,255,641 to Schechter that provides an improvement in a camless variable valve control system by incorporating a rotary valve to control the high and low pressure hydraulic fluid supplied to and drawn from a hydraulic engine valve.

An advantage to the present invention is the reduced cost and complexity of the above noted system by eliminating the need for two solenoid valves per engine valve and employing at most one rotary valve to control at least one engine valve in a hydraulic system that incorporates a high pressure and a low pressure branch selectively connected to cavities above pistons mounted on respective engine valves.

DETAILED DESCRIPTION OF THE PREFERRED EMBODIMENTS

Figure 1:
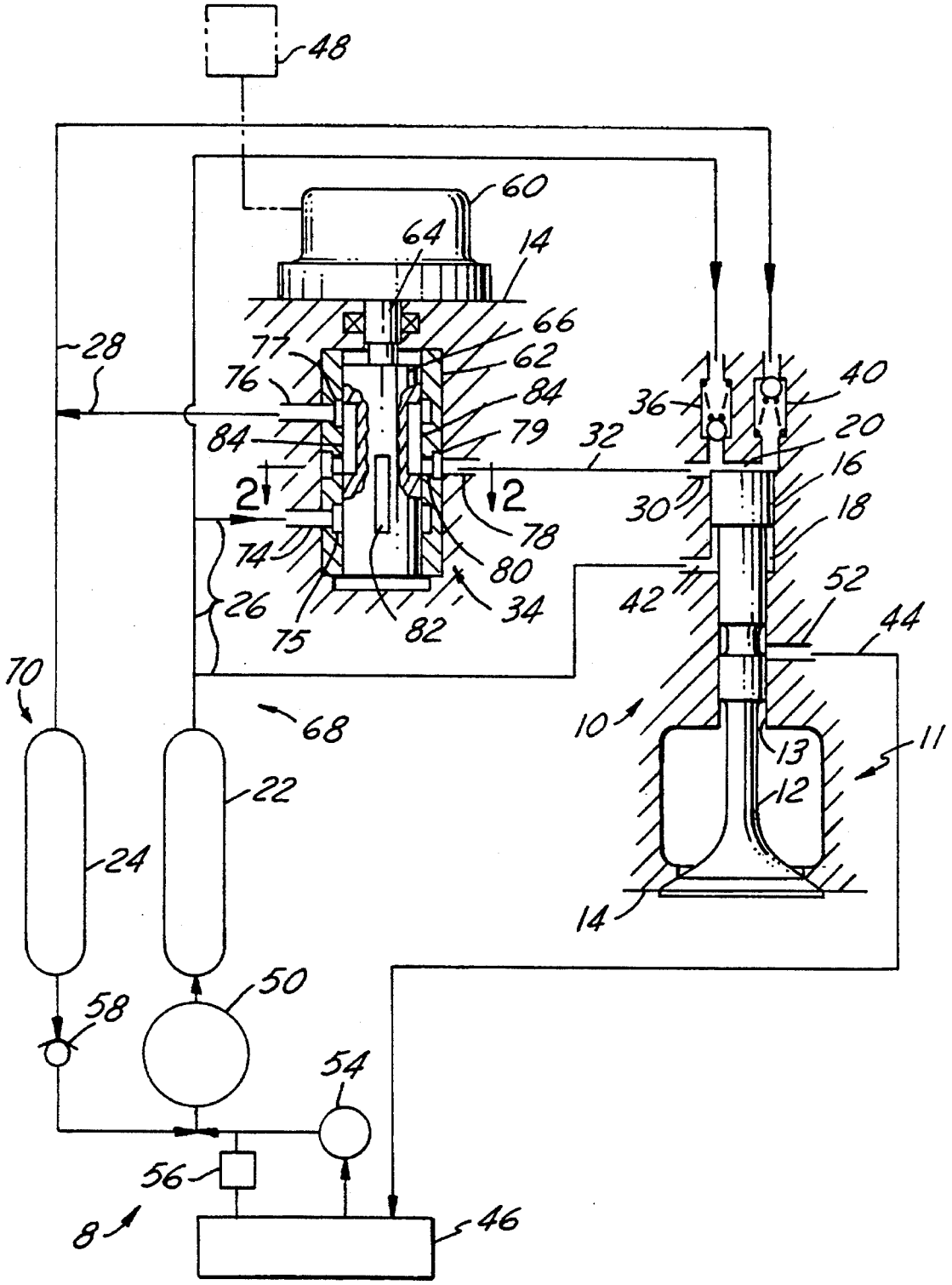
FIG. 1 is a schematic diagram showing a single engine valve, from an engine valvetrain, and an electrohydraulic system for selectively supplying hydraulic fluid to the engine valve.

FIG. 1 shows a hydraulic system 8, for controlling a valvetrain in an internal combustion engine, connected to a single electrohydraulic engine valve assembly 10 of the electrohydraulic valvetrain. An electrohydraulic valvetrain is disclosed in U.S. Pat. 5,255,641 to Schechter assigned to the assignee of this invention), which is incorporated herein by reference.

An engine valve 12, for inlet air or exhaust as the case may be, is located within a sleeve 13 in a cylinder head 14, which is a component of engine 11. A valve piston 16, fixed to the top of the engine valve 12, is slidable within the limits of piston chamber 18.

Hydraulic fluid is selectively supplied to a volume 20 above piston 16 through an upper port 30, which is connected to a rotary valve 34, via hydraulic line 32. Volume 20 is also selectively connected to a high pressure fluid reservoir 22 through a high pressure check valve 36 via high pressure lines 26, or to a low pressure fluid reservoir 24 via low pressure lines 28 through a low pressure check valve 40. A volume 42 below piston 16 is always connected to high pressure reservoir 22 via high pressure lines 26. The pressure surface area above piston 16, in volume 20, is larger than the pressure area below it, in volume 42.

In order to effectuate the valve opening and closing, a predetermined high pressure must be maintained in high pressure lines 26, and a predetermined low pressure must be maintained in low pressure lines 28. The preferred hydraulic fluid is oil, although other fluids can be used rather than oil.

High pressure lines 26 connect to high pressure fluid reservoir 22 to form a high pressure branch 68 of hydraulic system 8. A high pressure pump 50 supplies pressurized fluid to high pressure branch 68 and charges high pressure reservoir 22. Pump 50 is preferably of the variable displacement variety that automatically adjusts its output to maintain the required pressure in high pressure reservoir 22 regardless of variations in consumption, and may be electrically driven or engine driven.

Low pressure lines 28 connect to low pressure fluid reservoir 24, to form a low pressure branch 70 of hydraulic system 8. A check valve 58 connects to low pressure reservoir 24 and is located to assure that pump 50 is not subjected to pressure fluctuations that occur in low pressure reservoir 24 during engine valve opening and closing. Check valve 58 does not allow fluid to flow into low pressure reservoir 24, and it only allows fluid to flow in the opposite direction when a predetermined amount of fluid pressure has been reached in low pressure reservoir 24. From low pressure reservoir 24, the fluid can return directly to the inlet to pump 50 through check valve 58.

The net flow of fluid from high pressure reservoir 22 through engine valve 12 into low pressure reservoir 24 largely determines the loss of hydraulic energy in system 8. The valvetrain consumes oil from high pressure reservoir 22, and most of it is returned to low pressure reservoir 24. A small additional loss is associated with leakage through the clearance between valve 12 and its sleeve 13. A fluid return line 44, connected to a leak-off passage 52, provides a route for returning any fluid which leaks out to an oil sump 46.

The magnitude of the pressure at the inlet to high pressure pump 50 is determined by a small low pressure pump 54 and its associated pressure regulator 56 which supply a small quantity of oil to the inlet of high pressure pump 50 to compensate for the leakage through leak-off passage 52.

In order to control the supply of the high pressure and low pressure fluid to volume 20 above piston 16, hydraulic rotary valve 34 is employed. It is actuated by an electric rotary motor 60, which controls the rotational motion and position of rotary valve 34. Motor 60 is electrically connected to an engine control system 48, which activates it to determine the opening and closing timing. A motor shaft 64 rotationally couples motor 60 to a cylindrical rotary valve body 66. Engine control system 48 can cause motor 60 to rotate with angular velocity that is variable within each revolution.

A stationary valve sleeve 62 is mounted in and rotationally fixed relative to cylinder head 14. Valve body 66 is mounted within sleeve 62 and can rotate relative to it. The inner diameter of valve sleeve 62 is substantially the same as the outer diameter of valve body 66, allowing for a small tolerance so they can slip relative to one another. Cylinder head 14 includes three ports; a high pressure port 74 connected between high pressure line 26 and valve sleeve 62, a low pressure port 76 connected between low pressure line 28 and valve sleeve 62, and a third port 78 leading from valve sleeve 62 to volume 20 above engine valve piston 16 via hydraulic line 32.

Valve sleeve 62 includes two annular channels running about its inner circumference that correspond to the two ports 74 and 76 such that fluid can flow from a port into its corresponding sleeve channel. A high pressure sleeve channel 75 is positioned adjacent to high pressure port 74, and a low pressure sleeve channel 77 is positioned adjacent to low pressure port 76. Valve sleeve 62 also includes a third sleeve channel 79 running about the outer periphery of sleeve 62 that is positioned adjacent to third port 78 such that fluid can flow between the two. A pair of diametrically opposed windows 80 are included in valve sleeve 62, located along the inner circumference of it, and connecting to third sleeve channel 79.

Valve body 66 includes a pair of high pressure grooves 82 and a pair of low pressure grooves 84. High pressure grooves 82 are located opposite one another on the surface of valve body 66 and are positioned such that one end of each is always adjacent to high pressure channel 75 and the other end of each lies adjacent to one of the windows 80 twice per revolution of valve body 66 relative to valve sleeve 62. Low pressure grooves 84 are located opposite one another and 90 degrees from high pressure grooves 82. They are positioned such that one end of each always lies adjacent to low pressure channel 77 and the other end of each lies adjacent to one of the windows 80 twice per revolution of valve body 66 relative to valve sleeve 62.

When valve body 66 is positioned such that no grooves 82 and 84 align with windows 80, which is its closed position, rotary valve 34 keeps third port 78 disconnected from the other two, 74 and 76. Rotating motor 60 until high pressure grooves 82 align with windows 80 connects third port 78 with high pressure port 74. Rotation until low pressure grooves 84 align with windows 80 causes third port 78 to connect with low pressure port 76.

The timing of the process of engine valve opening and closing for the system of FIG. 1, taking place during one half of a rotary valve revolution, is graphically illustrated in FIGS. 2A–2D and 3A–3D. Engine valve opening is controlled by rotary valve 34 which, when positioned to allow high pressure fluid to flow from high pressure line 26 into volume 20 via hydraulic line 32, causes engine valve opening acceleration, and, when re-positioned such that no fluid can flow between line 26 and line 32, results in engine valve deceleration. Again re-positioning rotary valve 34, allowing hydraulic fluid in volume 20 to flow into low pressure line 28 via hydraulic line 32, causes engine valve closing acceleration, and, when re-positioned such that no fluid can flow between line 28 and 32 results in deceleration.

Figure 2A:
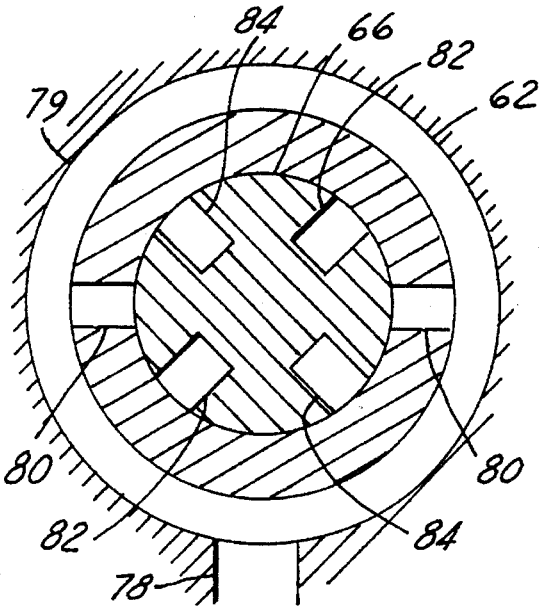
FIGS. 2A–2D are sectional views taken along line 2—2 in FIG. 1 illustrating various positions of the rotary valve during engine valve operation.
Figure 2B:
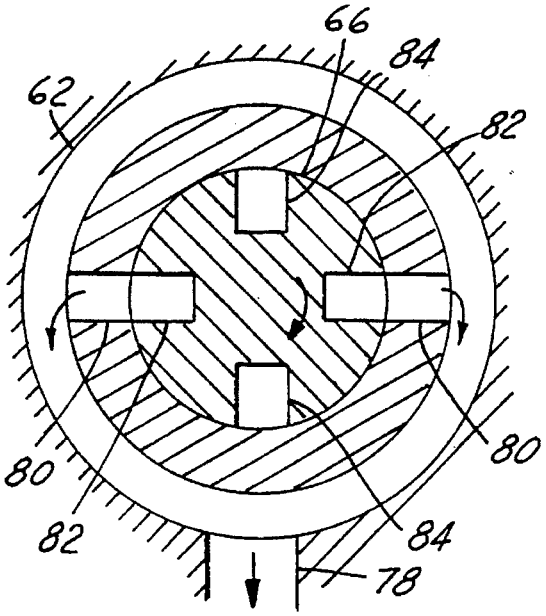
Figure 2C:
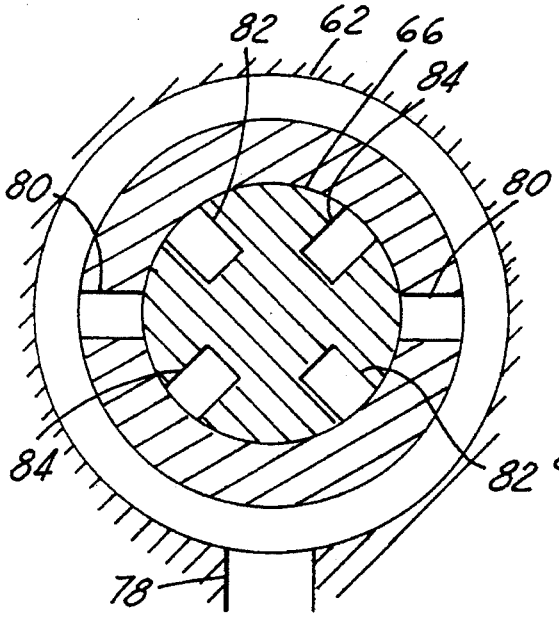

Thus, the process begins with engine valve 12 closed and no grooves aligned with windows, a closed position; FIG. 2A. To initiate engine valve opening, engine control system 48 activates motor 60 to accelerate rotary valve body 66 so that high pressure grooves 82 align with windows 80; FIG. 2B. Motor 60 then decelerates valve body 66. The area of grooves 82 exposed to windows 80 increases as they become fully aligned; 102 in FIG. 3B. High pressure fluid flows into volume 20 and the net pressure force acting on piston 16 accelerates engine valve 12 downward; 100 in FIG. 3A. Engine control system 48 then continues causing motor 60 to rotate rotary valve body 66 as motor 60 decelerates further until high pressure grooves 82 no longer align with windows 80; FIG. 2C. This is a spool valve closed position and valve body 66 is at rest; 108 in FIG. 3B. The pressure above piston 16 drops, and piston 16 decelerates pushing the fluid from volume 42 below it back through high pressure lines 26; 104 in Fig. 3A. Low pressure check valve 40 opens and fluid flowing through it prevents void formation in volume 20 above piston 16 during deceleration; 106 in FIG. 3C. When the downward motion of engine valve 12 stops, low pressure check valve 40 closes and engine valve 12 remains locked in its open position; 110 in FIG. 3A.

Figure 2D:
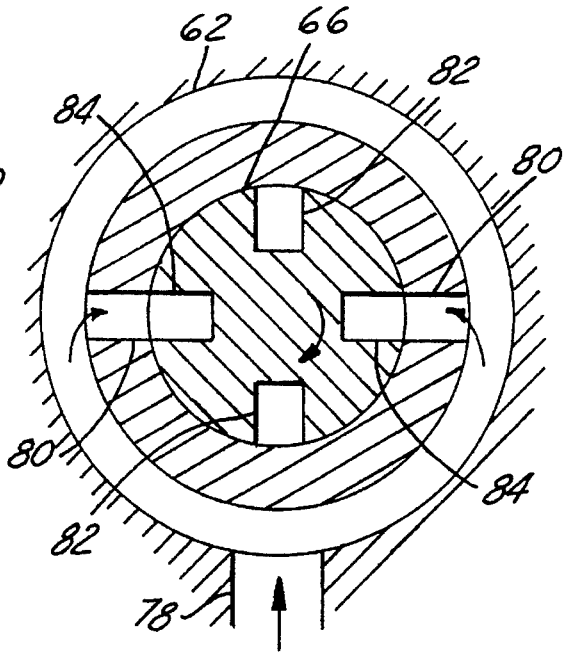
Figures 3A, 3B, 3C, 3D:
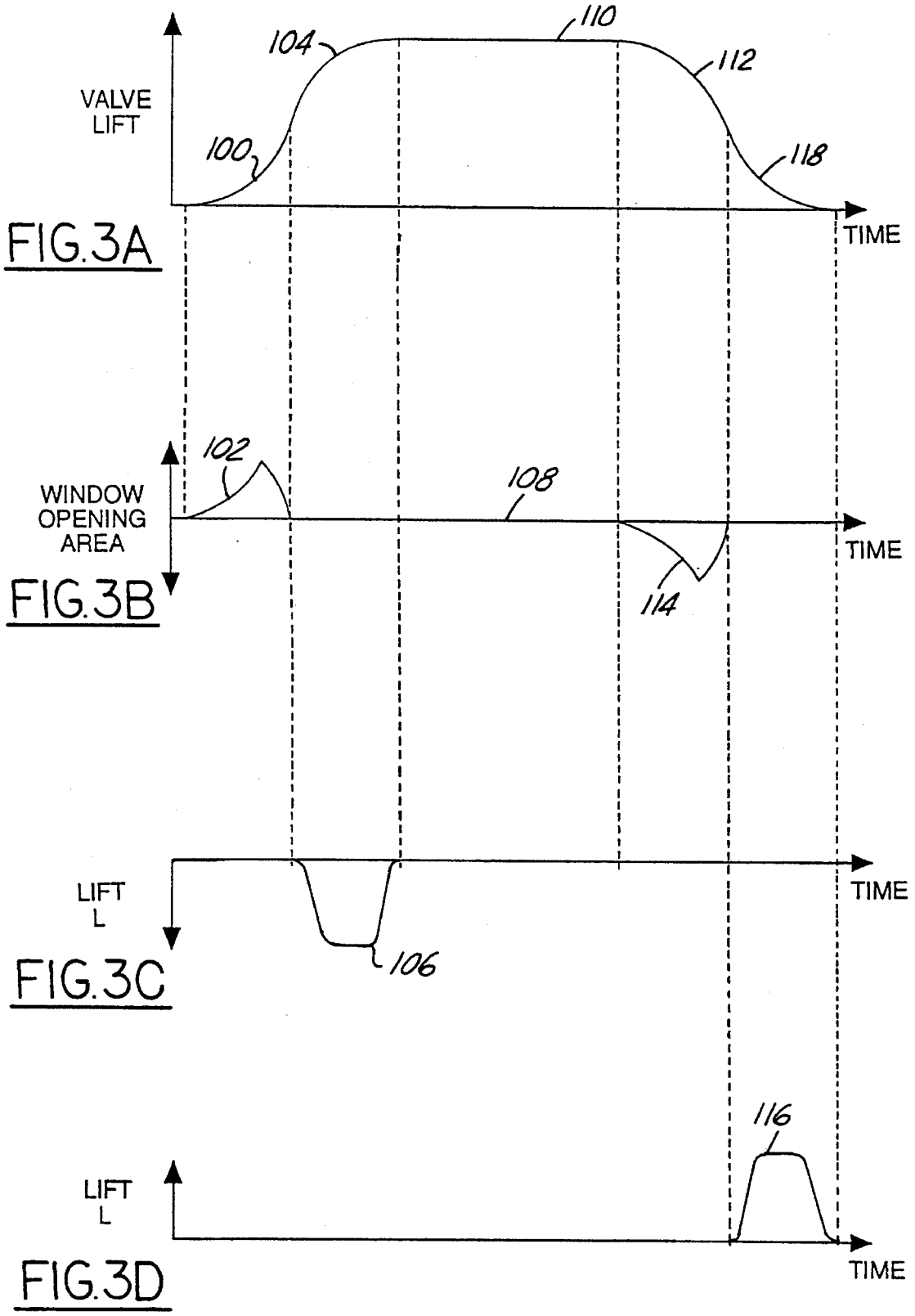
FIGS. 3A–3D are graphs showing the relative timing of the engine valve lift, rotary valve movement and the low and high pressure ball check valve opening, respectively.

The process of valve closing is similar, in principle, to that of valve opening. Engine control system 48 activates motor 60 to rotationally accelerate rotary valve body 66 so that low pressure grooves 84 align with windows 80; FIG. 2D. Motor 60 then decelerates the valve body 66. The area of grooves 84 exposed to windows 80 increases as they become aligned; 114 in FIG. 3B. Fluid flows from volume 20 as the pressure above piston 16 drops and the net pressure force acting on piston 16 accelerates engine valve 12 upward; 112 in FIG. 3A. Engine control system 48 then causes motor 60 to further decelerate rotary valve body 66 until low pressure grooves 84 no longer align with windows 80. Again rotary valve is in a closed position in which valve body 66 is at rest. The pressure above piston 16 rises, and piston 16 decelerates; 118 in FIG. 3A. High pressure check valve 36 opens as fluid from volume 20 is pushed through it back into high pressure hydraulic line 26 until valve 12 is closed; 116 in FIG. 3D. During the second half of the rotary valve revolution, the same sequence of events is repeated again. Therefore, the mean angular velocity of valve body 66 is one quarter of the engine crankshaft speed. At high engine speed, it may become unnecessary to bring rotary valve body 66 to a complete stop while in the closed positions.

Varying the timing of window crossings by high and low pressure grooves 82 and 84 varies the timing of the engine valve opening and closing. Valve lift can be controlled by varying the duration of the alignment of high pressure grooves 82 with windows 80. The duration of the alignment is a function of the angular velocity and angular acceleration of valve body 66 during the alignment. It can be controlled by varying the magnitude and the direction of the driving torque from motor 60. Varying the fluid pressure in high pressure reservoir 22 also permits control of engine valve acceleration, velocity and travel time.

During each acceleration of engine valve 12, potential energy of the pressurized fluid is converted into kinetic energy of the moving valve 12 and then, during deceleration, when valve piston 16 pumps the fluid back into high pressure reservoir 22, the kinetic energy is converted back into potential energy of the fluid. Such recuperation of hydraulic energy contributes to reduced energy requirements for the system operation.

Figure 4:
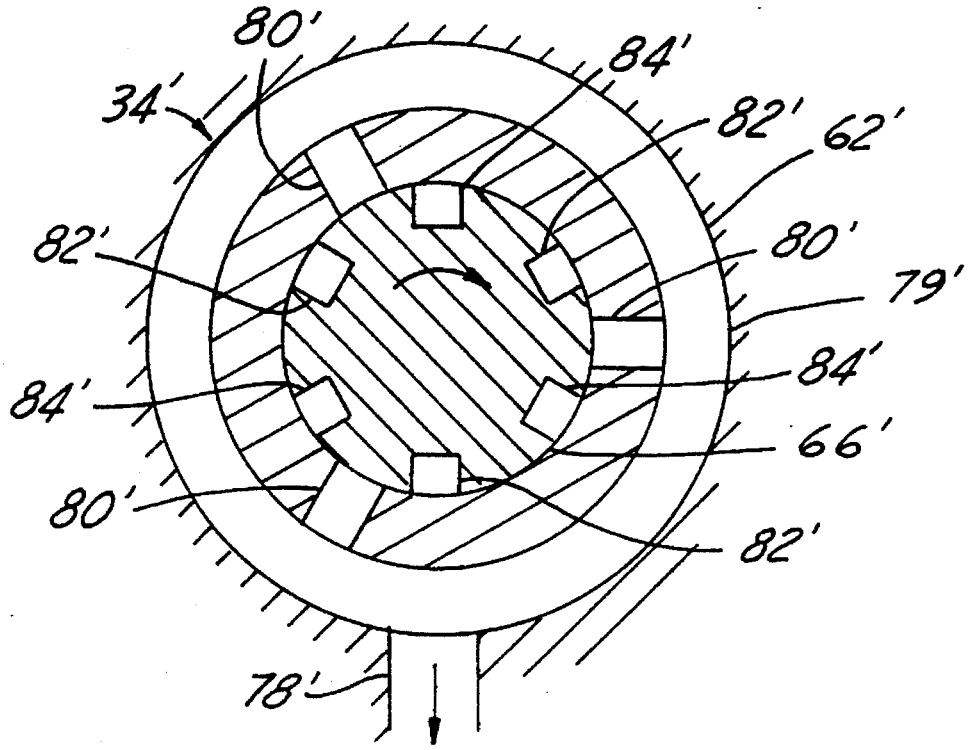
FIG. 4 is a section view similar to FIGS. 2A–2D illustrating a first alternate embodiment.

A first alternate embodiment of the present invention is illustrated in FIG. 4. For purposes of this description, elements in the FIG. 4 construction that have counterpart elements in the FIG. 1 construction have been identified by similar reference numerals, although a prime is added. It includes three high pressure grooves 82', three low pressure grooves 84' and three windows 80' rather than two of each. This configuration allows three engine valve events to be completed during each revolution of valve body 66'. Other numbers of groove/window combinations can also be used, although it is desirable to locate the grooves so that the hydraulic pressure forces acting on the rotary valve body 66' are balanced. Furthermore, internal passages can be used in the valve body instead of external grooves.

Figure 5:
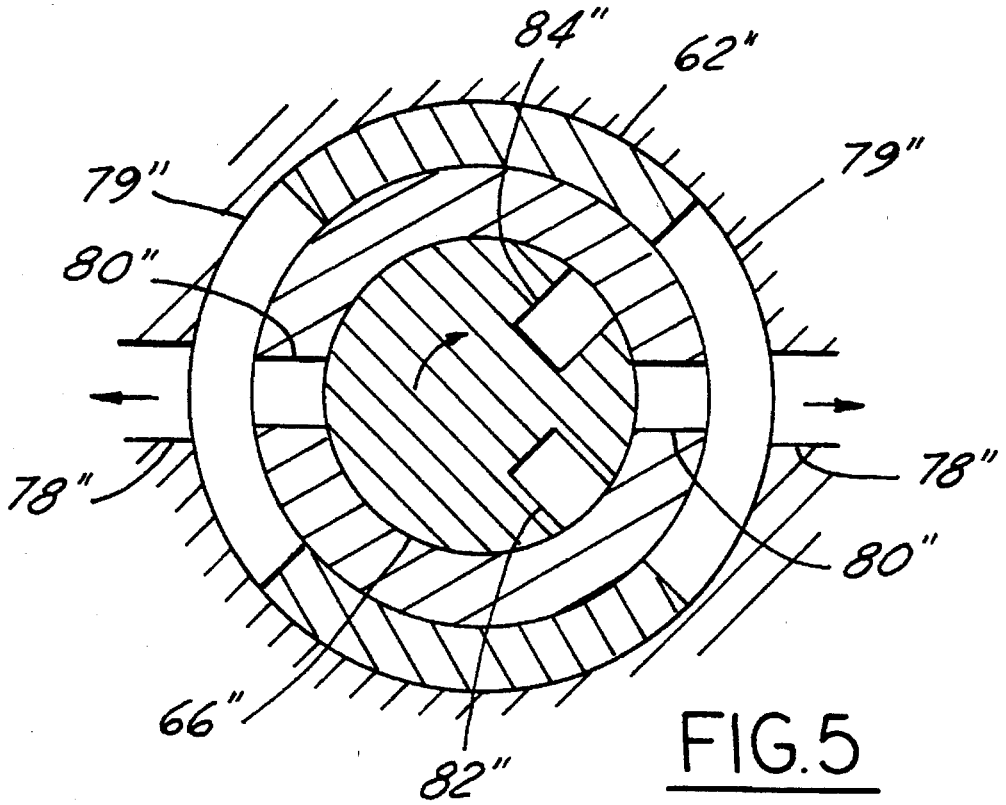
FIG. 5 is a section view similar to FIGS. 2A–2D illustrating a second alternate embodiment.

A second alternate embodiment is illustrated in FIG. 5. For purposes of this description, elements in the FIG. 5 construction that have counterpart elements in the FIG. 1 construction have been identified by similar reference numerals, although a double prime is added. In this embodiment, a single rotary valve independently controls two engine valves. Two third ports 78" each lead to a different engine valve and are aligned with separate third sleeve channels 79". A single high pressure groove 82" and a low pressure groove 84" are provided in rotary valve body 66". During the first half of the rotary valve revolution, hydraulic connections of high and low pressure are provided to a first engine valve, and during the second half of the revolution, the same grooves 82" and 84" provide connections of hydraulic fluid to a second engine valve. Because engine control system 48 can cause motor 60 to vary its velocity and acceleration within each rotation of valve body 66", the valve events for the two valves can be different in timing, valve lift and event duration.

While certain embodiments of the present invention have been described in detail, those familiar with the art to which this invention relates will recognize various alternative designs and embodiments for practicing the invention as defined by the following claims.

I claim:

1. A hydraulically operated valve control system for an internal combustion engine, the system comprising:

a high pressure hydraulic branch and a low pressure hydraulic branch, having a high pressure source of fluid and a low pressure source of fluid, respectively;

a cylinder head member adapted to be affixed to the engine and including an enclosed bore and chamber;

an engine valve shiftable between a first and a second position within the cylinder head bore and chamber;

a hydraulic actuator having a valve piston coupled to the engine valve and reciprocable within the enclosed chamber which thereby forms a first and a second cavity which vary in displacement as the engine valve moves;

a rotary valve assembly mounted to the cylinder head member including a sleeve and a cylindrical valve body mounted within the sleeve, with the valve body including at least one high pressure groove and at least one low pressure groove and with the sleeve including three channels and at least one window operatively engaging the third sleeve channel;

the cylinder head member including three ports, a first port connecting the first sleeve channel to the high pressure branch, a second port connecting the second sleeve channel to the low pressure branch and a third port connecting the third sleeve channel to the first cavity, with the three ports and sleeve channels being oriented such that the valve body can be rotated so that the high pressure groove aligns with the first sleeve channel and the window, neither of the grooves aligns with the window, and the low pressure groove aligns with the second sleeve channel and the window, sequentially; with the cylinder head member further including a high pressure line extending between the second cavity and the high pressure branch; and actuator means for rotating the rotary valve relative to the sleeve.

2. A hydraulically operated valve control system according to claim 1 wherein the actuator means comprises a rotary motor, a central shaft coupled between the motor and the valve body, and control means cooperating with the rotary motor for selectively changing the rotational speed of the motor.

3. A hydraulically operated valve control system according to claim 1 further including a high pressure check valve mounted between the first cavity and the high pressure source of fluid.

4. A hydraulically operated valve control system according to claim 1 further including a low pressure check valve mounted between the first cavity and the low pressure source of fluid.

5. A hydraulically operated valve control system according to claim 1 wherein the surface area of the valve piston exposed to the first cavity subjected to fluid pressure is larger than the surface area of the valve piston exposed to the second cavity subjected to fluid pressure.

6. A hydraulically operated valve control system according to claim 1 wherein the at least one high pressure groove is two high pressure grooves, the at least one low pressure groove is two low pressure grooves and the at least one window is two windows, positioned such that the windows will sequentially align with the two high pressure grooves simultaneously and then with the two low pressure grooves simultaneously.

7. A hydraulically operated valve control system according to claim 1 wherein the at least one high pressure groove is three high pressure grooves, the at least one low pressure groove is three low pressure grooves and the at least one window is three windows positioned such that the windows will sequentially align with the three high pressure grooves simultaneously and then with the three low pressure grooves simultaneously.

8. A hydraulically operated valve control system according to claim 1 further comprising:

a second bore and chamber included in the cylinder head;

a second engine valve shiftable between a first and a second position within the cylinder head second bore and chamber;

a second hydraulic actuator having a second valve piston coupled to the second engine valve and reciprocable within the enclosed second chamber which thereby forms a first and second cavity which vary in displacement as the second engine valve moves; and the at least one window being two windows and the third sleeve channel being divided into two portions, the first portion operatively connected to the first cavity of the first engine valve and the second portion operatively connected to the first cavity of the second engine valve.

9. A hydraulically operated valve control system for an internal combustion engine, the system comprising:

a high pressure hydraulic branch and a low pressure hydraulic branch, having a high pressure source of fluid and a low pressure source of fluid, respectively;

a cylinder head member adapted to be affixed to the engine and including an enclosed bore and chamber;

an engine valve shiftable between a first and a second position within the cylinder head bore and chamber;

a hydraulic actuator having a valve piston coupled to the engine valve and reciprocable within the enclosed chamber which thereby forms a first and a second cavity which vary in displacement as the engine valve moves;

a rotary valve assembly mounted to the cylinder head member including a sleeve and a cylindrical valve body mounted within the sleeve, with the valve body including at least one high pressure groove and at least one low pressure groove and with the sleeve including three channels and at least one window operatively engaging the third sleeve channel;

the cylinder head member including three ports, a first port connecting the first sleeve channel to the high pressure branch, a second port connecting the second sleeve channel to the low pressure branch and a third port connecting the third sleeve channel to the first cavity, with the three ports and sleeve channels being oriented such that the valve body can be rotated so that the high pressure groove aligns with the first sleeve channel and the window, neither of the grooves aligns with the window, and the low pressure groove aligns with the second sleeve channel and the window, sequentially; with the cylinder head member further including a high pressure line extending between the second cavity and the high pressure branch;

an actuator mechanism including a rotary motor, a central shaft coupled between the motor and the valve body, and control means cooperating with the rotary motor for selectively changing the rotational speed of the motor;

a high pressure check valve mounted between the first cavity and the high pressure source of fluid; and a low pressure check valve mounted between the first cavity and the low pressure source of fluid.

10. A hydraulically operated valve control system according to claim 9 wherein the surface area of the valve piston exposed to the first cavity subjected to fluid pressure is larger than the surface area of the valve piston exposed to the second cavity subjected to fluid pressure.

* * * * *